United States Patent [19]

Baldridge

[11] 4,381,654

[45] May 3, 1983

[54] FUR STRETCHER

[76] Inventor: Lee M. Baldridge, 1263 Tehama, Oroville, Calif. 95965

[21] Appl. No.: 294,305

[22] Filed: Aug. 19, 1981

[51] Int. Cl.[3] ..... C14B 1/26

[52] U.S. Cl. ..... 69/19.2

[58] Field of Search ..... 69/19.1, 19.2, 19.3

[56] References Cited

U.S. PATENT DOCUMENTS

| | | | |
|---|---|---|---|
| 1,892,624 | 12/1932 | Nelson | 69/19.2 |
| 1,932,167 | 10/1933 | Weigand et al. | 69/19.2 |
| 2,231,903 | 2/1941 | Graham | 69/19.2 |
| 2,247,738 | 7/1941 | Welty | 69/19.2 |
| 2,485,242 | 10/1949 | Leighton | 69/19.2 |

*Primary Examiner*—Patrick D. Lawson

[57] ABSTRACT

Disclosed herein is a device for stretching fur pelts and the like which includes a first rack which initially receives and stretches the pelt thereon provided with several different forms of fastening devices, a second rack which is suitably configured to accommodate and receive the first rack thereon, a connecting area between the first and the second rack to operatively join together the two racks so that when the first and second racks are thusly disposed, additional beneficial stretching of the fur can occur.

7 Claims, 5 Drawing Figures

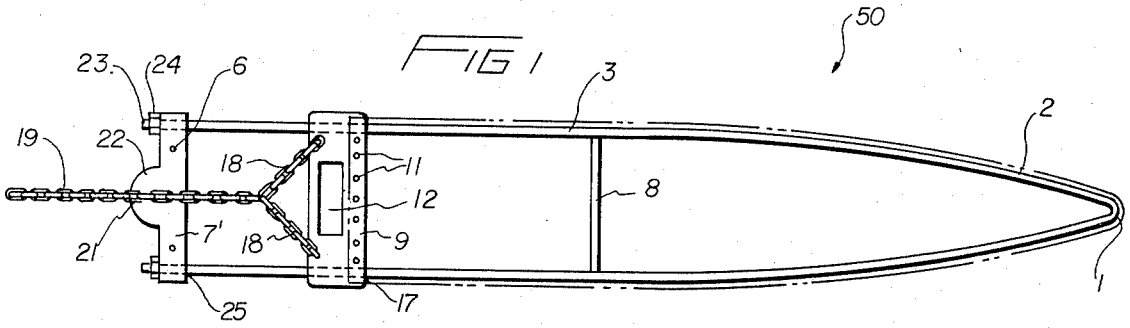
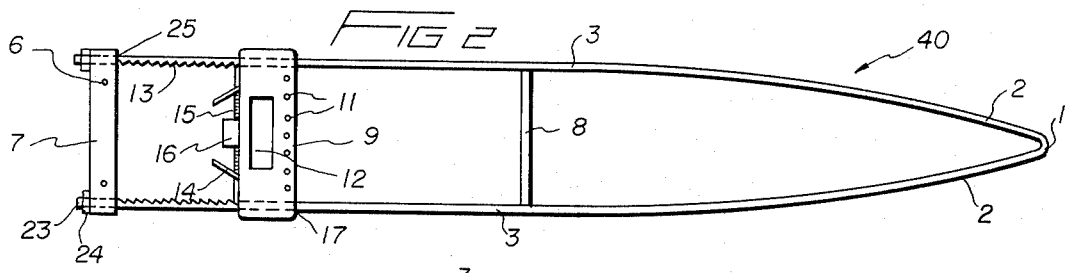
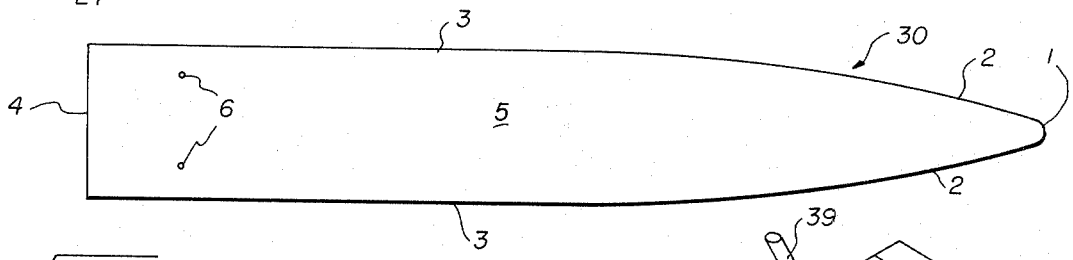
FIG 3
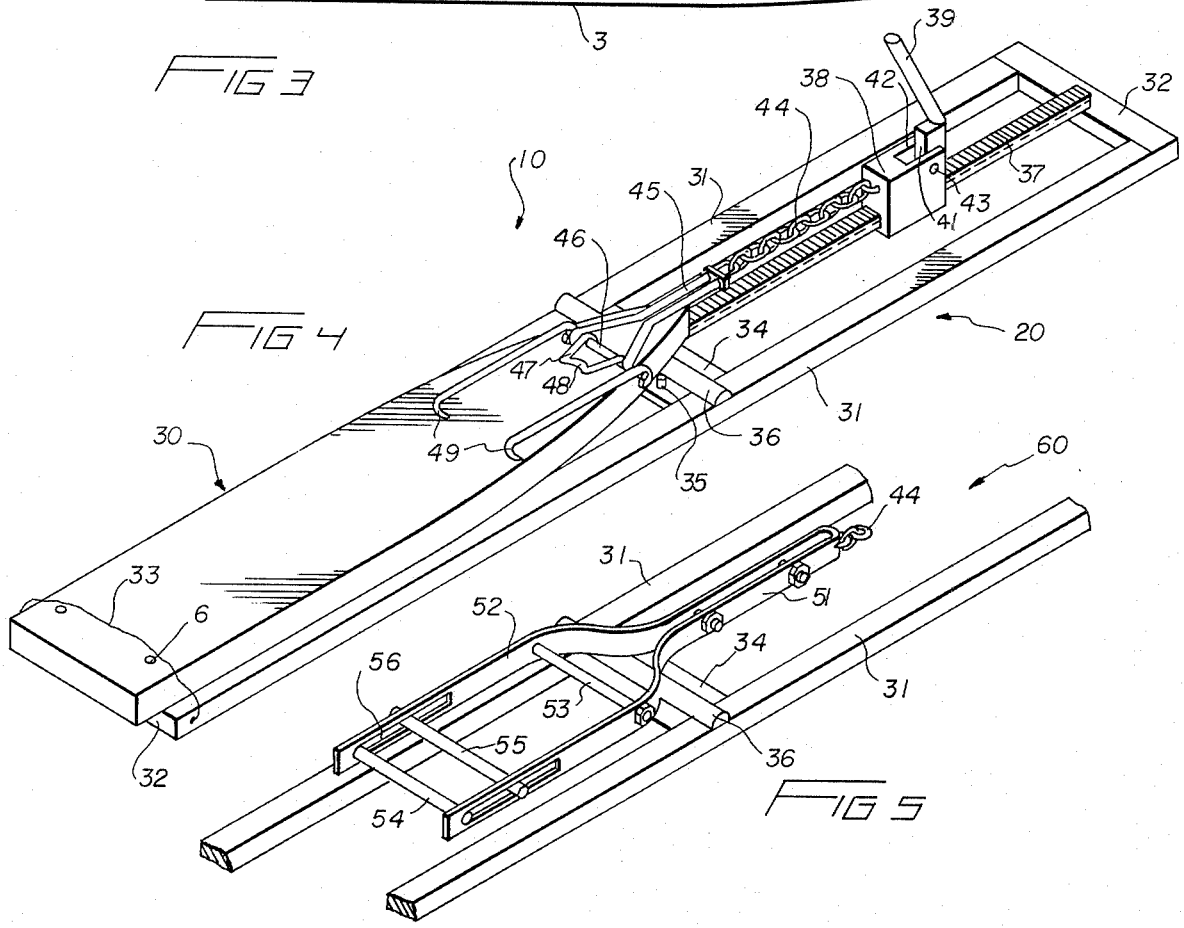
FIG 4
FIG 5

FUR STRETCHER

BACKGROUND OF THE INVENTION

This invention relates generally to devices for stretching fur and the like.

It is well known that the value of pelts is determined not only by the kind of animal that was the host, but also by the length of the fur which in many ways reflect the size and maturity of the animal. In this aspect, the art of stretching furs is one of considerable importance to trappers and traders and the like in furs since one's profit is directly related to the fur's dimensions.

Thus, it is extremely important to carefully but efficiently stretch fur pelts and the like to a maximum length.

The following patents reflect the state of the art of which applicant is aware in so far as these patents appear to be germane to the patent process:

| | | |
|---|---|---|
| 1,892,624 | Nelson | Dec. 27, 1932 |
| 1,932,167 | Weigand et al | Oct. 24, 1933 |
| 2,231,903 | Graham | Feb. 18, 1941 |
| 2,247,738 | Welty | July 1, 1941 |
| 2,485,242 | Leighton | Oct. 18, 1949 |

Of these, the patent to Leighton appears to be of great interest since he teaches the use of a fur stretching device in which a surrounding framework is provided along a longitudinal axis thereof with extensible means, one extremity of which is provided with a plurality of diverse tail engaging clamps or the like for contacting the pelt. It is to be noted that this device appears to be laterally as well as longitudinally extensible.

Graham teaches the use of a similar device in which a theaded central rod is operatively connected to side rails and transverse sections which are adapted to translate from the threaded rod as a function of rod turning so as to provide a stretching in two directions.

The patent to Nelson similarly is provided with a central member capable of longitudinal displacement which simultaneously causes the lateral portions of the fur to similarly stretch.

Likewise, Weigand et al teaches the use of a fur stretching frame which when deployed provides extensibility in two directions.

Welty teaches the use of an adjustable fur stretcher which also provides lateral deflection but to an apparent lesser degree than the prior art devices.

By way of contrast, the instant application is directed to a first stretching rack upon which a pelt is initially disposed for a preliminary stretching in two directions. Once the initial stretching has been effected, the pelt while still mounted on the first rack is disposed upon a second rack for further stretching only in a longitudinal direction. The first and second racks are suitably fashioned to allow the rapid assemblage of the first rack to the second rack so that an additional secondary stretching of the pelt can be effected, it having been found that subsequent stretching as is disclosed herein will increase the overall length of the pelt by a range from ten to thirty percent.

Whereas prior art devices assumed a relationship between lateral and longitudinal stretching within a single frame, within which the stretching occurs in two direction simultaneously at a predetermined rate. By using the apparatus of the instant application, a greater and more uniform stretching can be effected which is not totally dependent upon the ability of the pelt to be tensioned in two directions simultaneously.

SUMMARY AND OBJECTS OF THE INVENTION

Accordingly, this invention has as an object to provide an improved fur stretcher which initially allows the pelt to be stretched in two directions and remain in a tensioned condition.

It is a further object of this invention to provide a device of the character described above which once stretched in two directions can be additionally stretched along its longitudinal length without suffering any unwanted contraction in a latitudinal direction, thereby providing a pelt of substantially the same width of the prior art devices, but of substantially greater length.

It is yet a further object of this invention to provide a device of the character described above which is formed from first and second rack members so that plural pelts can be initialized on the first rack and then subsequently stretched serially by a second rack.

It is still a further object of this invention to provide a device of the character described above in which the first and second racks can be expeditiously interfaced and operatively connected to further stretching for the purposes set forth above.

It is still a further object of this invention to provide a device of the character described above which is relatively inexpensive to manufacture, extremely durable in construction, and safe to use.

It is still a further object of this invention to provide a device of the character described above having improved grasping means for engaging the pelt so as to more uniformly distribute forces through the entire membrane of the pelt than the prior art would suggest, thereby providing greater elongation of the pelt.

These and other objects will be made manifest when considering the following detailed specification when taken in conjunction with the appended drawing figures in which there is provided a device for stretching fur pelts or the like which includes a first rack means which initially receives and stretches the pelt in a latitudinal and longitudinal direction, a second rack means for receiving the first rack means and a portion of the pelt in such a manner that the pelt can be additionally stretched along its longitudinal extent, and connection means for fastening together the first and second rack means whereby the pelt is stretched further by displacing said first rack means from said second rack means.

BRIEF DESCRIPTION OF THE DRAWING FIGURES

FIG. 1 is a top plan view of the first rack according to the present invention.

FIG. 2 s a top plan view of a first alternative embodiment of FIG. 1.

FIG. 3 is a second alternative embodiment to that which is shown in FIGS. 1 and 2.

FIG. 4 is a perspective view of the embodiment as shown in FIG. 3 disposed upon the rack according to a preferred form of the invention.

FIG. 5 is a partial view of retention means that can be carried on the second rack shown in FIG. 4.

BRIEF DESCRIPTION OF THE PREFERRED EMBODIMENT

Referring to the drawings now, wherein like reference numerals refer to like parts throughout the various drawing figures, reference numeral 10 is directed to the fur stretcher (FIG. 4) according to a preferred form of the invention.

The stretcher 10 includes a second rack 20 upon which a first rack 30 is disposed in a manner to be defined. By way of example, while FIG. 4 shows the third embodiment of a first rack disposed upon the second rack 20, the rack 40 of FIG. 2 or the rack 50 of FIG. 1 could be similarly disposed upon the second rack 20 as will be discussed. In addition, reference numeral 60 in FIG. 5 teaches the use of a second form of engaging means similar to what is shown in FIG. 4, a notable distinction being that the engaging means of FIG. 4 is adapted to engage the head area of a fur pelt, and the attachment means of FIG. 5 is adapted to constrain the tail portion of the fur pelt.

In a preferred form, the first rack 30 (FIG. 3) is formed as a substantially non-foraminous body 5 having a leading tip 1, outwardly flared sidewalls 2 extending from the tip 1, the sidewalls 2 gradually forming spaced parallel sidewalls 3 which are coextensive, and terminate in an endwall 4 interconnecting both parallel sidewalls and substantially orthogonal to the sidewalls 3. Recesses and pins 6 are disposed on the board for purposes to be assigned hereinafter.

FIG. 2 teaches the use of a second form of the first rack 40, in which like reference numerals refer to like parts, the most notable difference is that the first rack is formed as a skeletal framework having merely the sidewalls and tip and further reinforcing ribs. Specifically, the endwall 7 takes the form of a bar having holes 25 at remote extremities thereof for the slidable insertion therein of terminal portions of the sidewalls 3. In this manner, and in conjunction with a threaded portion 23 on the sidewall 3, a nut 24 may be affixed thereon to form a rigid structure. An interbrace 8 is provided between the opposed sidewalls 3 just rearwardly of the flared sidewalls 2 as shown in the drawings.

In addition, however, innerfaces of the sidewalls 3 near the endwall 7 are provided with serrated teeth 13 which form a locking ratchet type of engagement with a fur stretching tail piece 9 shown in FIG. 2. The fur stretching tail piece 9 includes a plurality of upwardly extending spikes 11 for penetration into the tail portion of the pelt and the tail piece 9 includes an opening 12 in which a terminal portion of the tail is disposed. The tail piece 9 is adapted to slidably translate along the length of the two opposed sidewalls 3 by means of openings 17 disposed on corresponding side portions of the tail piece 9, and the fur can be stretched and caused to remain in a tensioned condition by means of the serated teeth interengaging with locking tabs 14 having terminal portions proximate to the serrated teeth 13 adapted to engage the teeth, the locking tabs 14 including a hand grasping area remote from the teeth for deflection inwardly away from the teeth so as to adjust the tail piece. The tabs when removed from the teeth work against a spring tension, the spring 15 being disposed between the tabs and a central support housing 16 which not only carries a portion of the spring but also a portion of the tabs 14.

FIG. 1 is somewhat similar to FIGS. 2 and 3, but the retention of the fur stretching tail piece 9 differs from the embodiment of FIG. 2.

Specifically, a chain 19 having a bight portion 18 attached at extremities of the tail piece 9 are connected and locked by means of a notch 21 carried on a trailing edge of the endwall 7, the endwall 7 being provided with a trailing thickened area 22.

In use and operation, each of the first rack means 30,40 and 50 engage the pelt by disposing a mouth portion of the pelt on the tip 1, engaging by stretching the remainder of the body portion over the rearwardly extending support structure and providing the appropriate tension. Thereafter, however, when subsequent stretching may be desired, an apparatus for same is shown in FIG. 4 and an altenative in FIG. 5.

FIG. 4 shows the first rack 30 disposed on a second rack 20, the second rack 20 having the following structure. A pair of spaced parallel elongate frame members 31 are interconnected by cross beams 32 to form a substantially rectangular grid. Intermediate the cross beams 32 there is provided a further support beam 34 on a top face of which is fixedly positioned a semi-cylindrical solid 36.

The board 30, for example, is placed with the leading edge or tip just on top of the semi-cylindrical solid 36 (for stretching by the head of the pelt) and a tether 33 fastened to second rack 20 is looped over the support pegs 6 as shown. In this manner, the first rack is constrained from motion in at least one direction relative to the second rack. A further set of pegs 35 are provided proximate to and on one side of the semi-cylindrical solid 36 on support beam 34 so as to further constrain the outwardly flared sidewalls 2 as shown in the drawings.

A rack 37 extends between support beam 34 and the one cross beam 32 remote from the first stretching rack 30, and upon rack 37 a jack mechanism capable of translation along the length of the rack is provided. Specifically, the jack includes an advancing lever 39 having a downwardly projecting gear piece 41 adapted to engage the rack which is formed from a plurality of teeth. The jack includes a housing 38 having a bifurcated terminus 42 within which the gear piece 41 is pivotally disposed through pivot pin 43. Facing the first rack 30, a chain 44 extends affixed at one end to the housing 38 and at another end to a head engaging means for the pelt.

The head engaging means includes a wishbone shaped section 45 formed from two rods extending away from the chain 44, the wishbone section 45 having looped termini remote from the chain 44 through which an axle 46 is fixed. The axle 46 also supports thereon an animal mouth engaging section having a substantially W-shaped configuration when viewed from a top plan view, a point 48 within the W (forming an axis of symmetry) and allows the upper inner lip of most animals to rest therewithin and therebelow. The topmost portions of the W are provided with similar type of loops which is affixed around the axle 46. In addition, the head engaging means includes first and second hooks 49 looped around the axle and extending downwardly therefrom and having curved ear engaging termini which are disposed within the ear canals of the pelt to be stretched. Thus, the head engaging means constrains the pelt at three areas, all commonly supported by the cranial section of the pelt so that force exerted on the pelt by motion of the jack housing 38 away from the pelt causes a uniform force to be translated along the longitudinal extent of the pelt in a preferred manner, minimizing tearing of the pelt and promoting even greater stretching than was possible by just using the first rack 30,40 or 50.

Prior to stretching the pelt from a head area however it is sometimes desirable to stretch the pelt from the tail initially. In this event, FIG. 5 teaches the use of a preferred apparatus, the tail engaging stretching second rack 60 functioning as follows. The tail portion of the pelt is placed proximate to the rack area as is suggested by reversing 30 in FIG. 4 and a chain 44 is similarly provided for use with the rack 37. A tail engaging means is provided (FIG. 5) which includes a framework having a base 51 interconnected by nuts and bolts terminating in an outwardly flared substantially U-shaped section having side rail members 52 interconnected by cross bar 53 and at an extremity remote from the chain 44 a further cross bar 54. Longitudinally extending elongate slots 56 are provided on both of the side rail members 52 and slidably disposed therewithin is a sliding bar 55. In use and operation, the pelt tail extends underneath the cross bar 54 and is looped over the sliding bar 55 and threaded back underneath the cross bar 54 so that when tension is applied, the sliding bar 55 is pulled rearwardly in the direction of the pelt so as to firmly affix the tail portion of the pelt against the second rack means so that by translation of the chain 44 to the right as shown in FIG. 5 additional stretching has been provided. As stated above, it is desired that after initial pre-stretching by the use of the frames in FIGS. 1, 2 or 3, that subsequent stretching can be effected by first stretching the tail with the apparatus shown in FIG. 5, and thereafter reversing the pelt on the first supporting and stretching rack 30 and engaging the head of the pelt with the head engaging means.

Moreover, having thus described the invention, it should be apparent that numerous structural modifications are contemplated as being a part of this invention as set forth hereinabove and as defined hereinbelow by the claims.

What is claimed is:

1. A device for stretching a fur pelt and the like comprising, in combination:

a first rack means for initially receiving and stretching the pelt, a second rack means for receiving said first rack means and a portion of the pelt and connection means for fastening together said first and second rack means whereby the pelt is stretched further by displacing the pelt while said first rack means is held stationary by said second rack means.

2. The device of claim 1 wherein said second rack means comprises first and second spaced parallel frame members having cross beams interconnect at terminal portions thereof, a support beam parallel to and intermediate said cross beams extending between and supporting said frame members, a rack extending from said support beam to one said cross beam upon which jack means are disposed, means for engaging a portion of the pelt and attached to said jack means whereby moving said jack means along said rack extends and further stretches the pelt.

3. The device of claim 2 wherein said first rack means includes means for stretching the pelt.

4. The device of claim 3 wherein said pelt engaging means includes a chain extending from said jack means to a substantially U-shaped tail engaging means, said tail engaging means having first and second spaced cross bars extending between sidewalls defining said U-shaped tail engaging means, and a sliding bar disposed within slots on said sidewalls whereby a tail portion can be looped over said sliding bar and pressed between said sliding bar and a cross bar for firm retention.

5. The device of claim 3 wherein said engaging means includes a wish-bone shaped member attached to said jack means via a chain, said wish-bone member terminating and provided with an axle at an extremity remote from said jack means, a mouth engaging means disposed upon said axle, and ear engaging termini similarly supported on said axle having curved tips adapted to reside within the ear canal of the pelt.

6. The device of claim 4 or 5 wherein said connection means tether said first rack means to said second rack means includes a plurality of pins extending therebetween and a tether line overlying at least two of said pins and affixed to one said rack means.

7. The device of claim 6 wherein said first rack means includes a framework having a tip, outwardly flared sidewalls which terminate into spaced parallel sidewalls, and an end wall disposed remote from said tip between said sidewalls, a tail piece disposed on said first rack means provided with means for engaging a tail portion of the pelt and means for stretching the tail portion of the pelt by placing the pelt mouth on said tip and pulling the tail portion from said tip.

* * * * *